US005675995A

United States Patent [19]

Gould

[11] Patent Number: 5,675,995

[45] Date of Patent: Oct. 14, 1997

[54] APPARATUS FOR PROCESSING TEXTILE GOODS

[75] Inventor: Bruce M. Gould, Fullerton, Calif.

[73] Assignee: Challenge RMF Inc., Industry, Calif.

[21] Appl. No.: 221,696

[22] Filed: Mar. 31, 1994

Related U.S. Application Data

[62] Division of Ser. No. 974,363, Nov. 9, 1992, Pat. No. 5,309,588, which is a continuation of Ser. No. 725,358, Jul. 3, 1991, abandoned.

[51] Int. Cl.[6] ..... D06F 21/10

[52] U.S. Cl. ..... 68/58; 68/142

[58] Field of Search ..... 68/29, 58, 142, 68/144, 146; 8/158, 159; 134/65, 119, 120, 132; 366/44, 59, 227, 40; 99/348

[56] References Cited

U.S. PATENT DOCUMENTS

| | | | |
|---|---|---|---|
| 2,255,028 | 9/1941 | Long | 68/144 X |
| 2,272,284 | 2/1942 | Zimarik | 68/144 X |
| 2,312,657 | 3/1943 | Locke | 68/58 X |
| 2,618,472 | 11/1952 | Castendyck | 366/44 |
| 2,697,637 | 12/1954 | Mittelstadt | 366/40 X |
| 3,567,189 | 3/1971 | Buelow | 366/44 |
| 4,086,369 | 4/1978 | Mutoh et al. | 429/519 |
| 4,188,127 | 2/1980 | Pawley | 366/44 |
| 4,657,771 | 4/1987 | Gould | 426/641 |
| 4,730,934 | 3/1988 | Schwing | 366/59 X |
| 4,841,751 | 6/1989 | Ricci | 68/29 |
| 4,881,385 | 11/1989 | Lambrechts | 68/29 |
| 4,994,294 | 2/1991 | Gould | 99/348 X |

*Primary Examiner*—Philip R. Coe
*Attorney, Agent, or Firm*—Lyon & Lyon LLP

[57] ABSTRACT

A method and apparatus for treating garments, particularly to impart a "stone-washed" look without using pumice stones, using an elongated drum having an inclined axis and two continuous helical flights placed within the drum. Garments subjected to treatment in the drum with liquids and chemicals normally used in stone-washing operations, but without pumice stones, will have an appearance and feel like that of a normally-formed stone-washed garment. The helical flights may also have projection fins to help the abrading operation. The method is much more economical in terms of both supplies, equipment, and labor than the conventional stone-wash technique.

17 Claims, 2 Drawing Sheets

APPARATUS FOR PROCESSING TEXTILE GOODS

This is a divisional of application(s) Ser. No. 07/974,363 filed on Nov. 9, 1992, now U.S. Pat. No. 5,309,588, which is, in turn, a continuation of Ser. No. 07/725,358, filed on Jul. 3, 1991, (now abandoned).

This invention is directed to an apparatus and method for processing textile goods, having particular applicability in treating garments such as denim garments to give a feel and appearance of having been stone-washed without actually subjecting the garments to such treatment.

BACKGROUND OF THE INVENTION

Some of the most popular garments today have a stone-washed appearance. Stone-washing is intended to give a garment at the time of purchase the look and feel normally achieved through repeated washings. Stone-washing, which involves tumbling wet garments with pumice stones to give the desired appearance and feel, has drawbacks including:

1. Pumice stones impart abrasion and impact upon the garments being treated. A heavier thread, therefore, is required, increasing the garment unit cost, while at the same time reducing the stitch rate in the sewing process and substantially reducing productivity.

2. Damage is caused to the seams and hems of stone-washed garments even though heavier thread is used; 15% or more of stone-washed garments have to be reworked at substantial cost. A significant number of the reworked garments are damaged to the extent that they must be downgraded in value and sold as seconds (irregulars).

3. Pumice stones are expensive; they break down and have to be replaced after only a few uses. The sand resulting from the breakdown of the pumice stones constitutes a substantial clean-up and disposal problem.

4. Pumice stones by their nature are highly abrasive, causing excessive equipment wear. Existing process drums are often replaced on an annual or biennial basis.

5. Stone-washing is extremely labor intensive as each garment has to be manually handled to remove pumice stone and sand from all pockets, sleeves, pant legs, etc.

GENERAL DESCRIPTION OF THE INVENTION

The present invention is directed to an apparatus and method for achieving a stone-washed effect in garments without requiring the presence of pumice stones and all the attendant disadvantages thereof.

A garment is placed into a rotating elongated drum having an inclined axis, an open end at its upper extremity and twin continuous helical flights throughout the length of the drum. The garment is then subjected to a process similar to that of stone-washing without the presence of pumice stones, resulting in the garment having the appearance and feel of stone-washing, yet without being made by a process having all of the disadvantages of pumice stone washing.

By operation, it has been discovered that the dynamics of the apparatus and method of the present invention exceed those of conventional tumbler-type washing and dyeing equipment. The action of the twin continuous helical flights produces a desired abrasion to the garments without necessitating the use of pumice stones, representing a clear cost saving.

The configuration of the helical flights causes a load of textile goods to progressively advance in the elongated drum as it rotates. Therefore, there is an ease and reduction of labor of loading as clogging of the opening is eliminated.

The twin continuous helical flights also facilitate unloading of the drum without a need to tilt the drum to empty its contents. The drum can be unloaded by rotating the drum in a direction opposite that used to place the garments into the drum and undertake garment treatment.

It has also been discovered that the fluid dynamics of the apparatus of the present invention allow for a reduction in the required quantities of liquid and chemicals for treating the garments as the rotating twin continuous helical flights at the bottom of the drum create a wave of fluid useful in garment treatment.

DETAILED DESCRIPTION OF THE DRAWINGS

Figure 1:
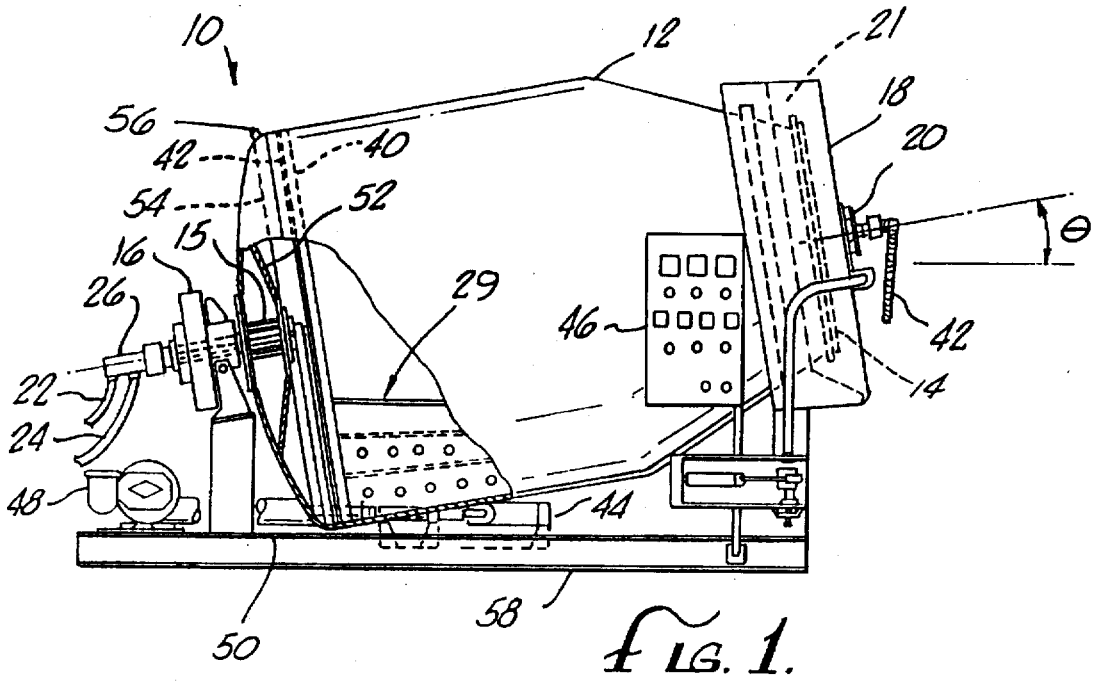
FIG. 1 is a side view of an apparatus of the present invention.

The apparatus generally designated as 10 has an elongated drum 12 in which garments to be treated or washed are placed. The upper end of drum 12 has an opening 14 through which the garments are placed in the drum. At the lower end of the elongated drum, a rotating shaft 15 is connected to the drum to permit rotation of the drum. The shaft rotates by operation of a gear reducer and a hydraulic motor, collectively indicated as 16. Additional details associated with hydraulic motor and gear reducer 16 will be apparent to those of ordinary skill in the art.

Drum 12 has an axis of rotation aligned with shaft 15. If desired, this axis of rotation may be inclined at an angle θ relative to horizontal. It has been found that an angle of inclination θ of the drum of 14° or more will cause streaking in the treated garments. Hence, it is preferred to use an angle of inclination of about 10°.

There is a cover 18 at the upper end of the elongated drum to keep the garments in the drum as they are being washed or treated. The cover preferably is equipped with a means to view the garments during processing. A representative example is a Leman$^R$ polycarbonate view ring. A locking mechanism (an overcenter clamp 20 and preferably more than one) is used to keep the cover on tight while the elongated drum is in operation. The locking mechanism can be unlocked and the cover can be swung up and to the side of the drum (see FIGS. 1 and 2) to permit either loading or removal of garments.

Figure 2:
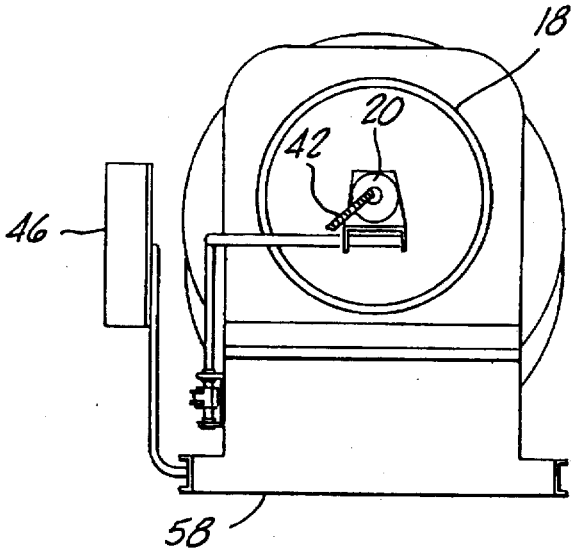
FIG. 2 is a top side view of the apparatus of FIG. 1.

A drum track and drum rollers are located under the cover at the upper end of the elongated drum, indicated in phantom by reference numeral 21 in FIG. 1. The arrangement of the drum track and rollers is intended to facilitate rotation of the drum. Additional structure associated with the drum track and rollers can be seen to advantage in Applicant's U.S. Pat. No. 4,994,294 issued Feb. 19, 1991, the entire disclosure of which is incorporated herein by reference.

The shaft at the lower end of the rotating drum is constructed to have lines (22,24) for the introduction of liquid materials into the drum. The distal end of the shaft is connected to a manifold through a "Duff-Norton" rotary union 26, a mechanism which allows the shaft to rotate in alignment with the manifold while the manifold remains stationary. Those skilled in the art will understand the precise construction of the rotary union.

The break-away view in FIG. 1, indicated at 29, reveals a portion of one of the continuous helical flights. Greater detail is found in FIG. 3, which is a top view depicting the interior of elongated drum 12. The pair of continuous helical flights 30, 32 go from the bottom of the elongated drum to its top, a configuration permitting ready passage of the garments from the top to the bottom of the drum when it is rotated in one direction. Rotating the drum in the opposite direction permits the garments to travel from the bottom to the top of the drum, which allows for easy removal of the treated or washed garments without having to tilt the elongated drum.

Figure 3:
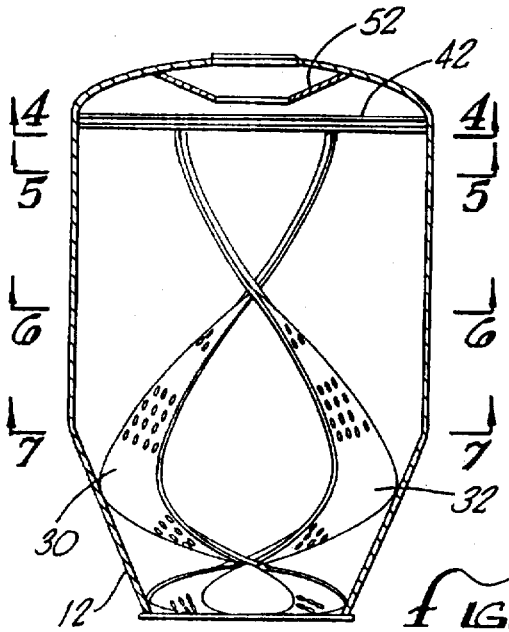
FIG. 3 is a top view of the interior of the elongated drum of the apparatus of the present invention, illustrating the orientation of the twin helical flights within the drum interior.
Figure 4:
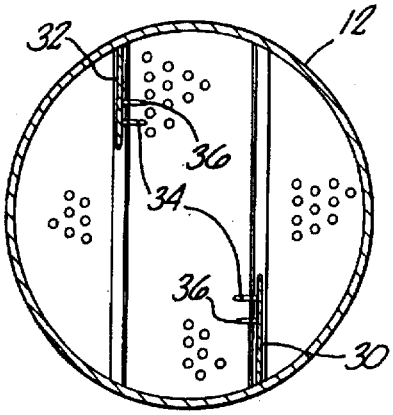
FIG. 4 is a view along section line 4—4 of FIG. 3.
Figure 5:
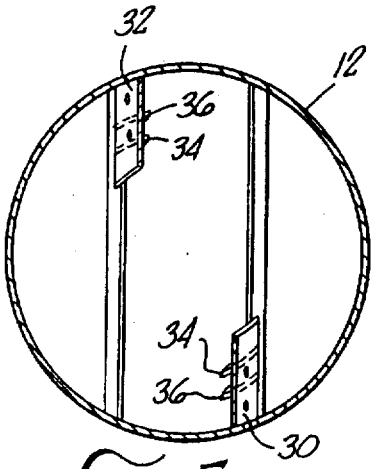
FIG. 5 is a view along section line 5—5 of FIG. 3.
Figure 6:
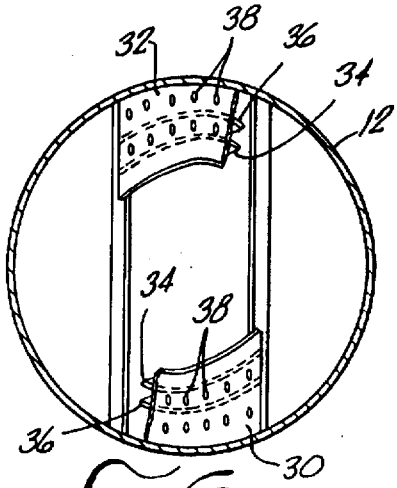
FIG. 6 is a view along section line 6—6 of FIG. 3.
Figure 7:
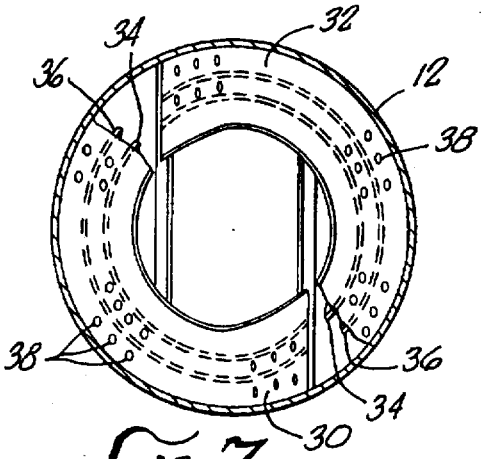
FIG. 7 is a view along section line 7—7 of FIG. 3.

Several cross-sectional views of drum 12, taken along lines 4—4 through 7—7 in FIG. 3, are respectively illustrated in FIGS. 4–7. FIGS. 4–7, taken in conjunction with FIG. 3, reveal the disposition of the continuous helical flights 30, 32 as the helical flights progress along the interior of the drum. The continuous helical flights are oriented 180° out of phase relative to each other and have a lead angle relative to the drum wall so that rotation of the drum in a first direction urges the garments within the drum towards the closed drum end, while rotation of the drum in the opposite direction will cause the garments to move from the closed drum end to the open drum end. The configuration helps to prevent tangling of the garments.

Figure 8:
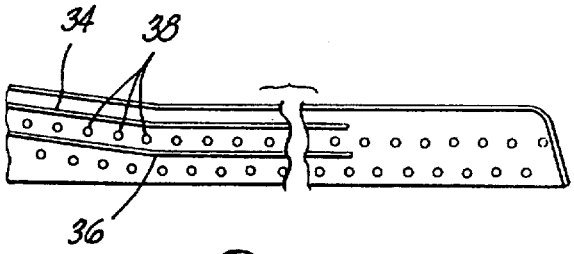
FIG. 8 is a view of one of the twin helical flights of the present invention, removed from the drum and arranged in planar fashion for illustrative purposes.

Each of the continuous helical flights 30, 32 (see FIGS. 3–7) contains a pair of projecting plates 34, 36 which extend part way along the sides of the flights, as illustrated in FIG. 8. These projecting plates (or fins) are especially useful when carrying out a stone-washing operation without stones as the projecting plates act as "abrasion" fins. In a preferred embodiment, the projecting plates can be located on opposing sides of the twin continuous flights. Holes 38 can also be provided in the flights to permit passage of liquid materials through the flights when the drum is in use.

Again referring to FIGS. 3–7, the continuous helical flights spiral from the closed end to the open end of the drum. The pitch of the spiral changes from very flat (small or close to straight) in the working zone of the drum and then increases near the open end for ease of discharge. The pitched flights produce the dynamics—akin to a massaging—for giving a stone-washed appearance and feel to garments; straight fins just lift and drop and cannot provide the necessary dynamics. The pitched flights also allow uniform distribution of the chemicals, particularly enzymes, to produce very desirable uniform results.

Returning to FIG. 1, the elongated drum has a drum drain screen 40 and a drain screen support 42. If any fasteners are present on the drum drain screen, the fasteners have to be arranged and placed so that when in use garment threads are not snagged. The continuous helical flights 30, 32 have a designated height at the drain screen support 42. The height then tapers down to a smaller value about half-way through the lower end of the elongated drum.

Treating liquids and chemicals enter the lower end of the elongated drum. The type of operation being carried out determines the nature of the liquids and chemicals entering the drum. For example, if the apparatus is used for laundry, the materials can be water, soap, and bleach. A stone-washing process requires water, enzymes, and pH adjusters.

The treating liquids and chemicals used to give a stone-washed appearance to garments are well known. They include, for example, sodium hypoclorite (bleach).

The apparatus also contains an injection system 42 for placing minor ingredients such as acetic acid into the apparatus.

A recirculation pump 44 is used to recirculate the liquids through the apparatus during use.

A control panel 46 is present and may contain, for example, digital timers, digital RPM display, digital temperature display, a digital pH monitor, and controls for operating in either a manual or automatic mode.

Power unit 48 is used to work in conjunction with heat exchanger 50 designed to control the temperature within elongated drum 12.

The elongated drum also contains an inner reinforcing cone 52, a bulkhead 54, and a drain plug 56. The full assembly is situated on a frame 58.

In addition to carrying out stone-washing of garments by the present apparatus and method, one can also perform a dyeing treatment when the stone-washing aspect of the operation is complete. When dyeing is done, the temperature within the drum is heated in conventional fashion to greater than 212° F., and preferably between about 220° F. and about 230° F.

Sometimes there is pressure inside the drain and the drum should be constructed to maintain a drum internal pressure of up to about 15 pounds per square inch.

Although the apparatus and method have been described with particular emphasis on "stone-washing," it is apparent that the apparatus can be used for other garment treating and processing methods, such as washing, relaxing, scouring, felting, Sanforizing, digestive processes and the like.

What is claimed is:

1. An apparatus for washing or treating garments comprising:

an elongated drum having an inclined axis;

an opening in the elongated drum for receiving the garments; and a pair of continuous helical flights of varying pitch located inside and throughout the length of the elongated drum, wherein each of the flights comprises two opposing sides, and wherein each flight includes at least two projecting plates extending longitudinally at least part way along at least one of the two opposing sides of each flight.

2. The apparatus of claim 1 further comprising means for covering the opening in the elongate drum, wherein the covering means includes a means for viewing the garments in the elongated drum.

3. The apparatus of claim 1 wherein said elongated drum has an angle of inclination of less than 14°.

4. The apparatus of claim 3 wherein said elongated drum has an angle of inclination of about 10°.

5. The apparatus of claim 1 wherein said pitch of the continuous helical flights is flat in a lower end of the elongated drum.

6. The apparatus of claim 5 wherein the pitch of the continuous helical flights increases near an upper end of the elongated drum.

7. An apparatus for washing or treating garments, the apparatus comprising:

an elongated drum having an interior into which the garments to be processed can be inserted;

a frame structure which supports the elongated drum for rotation about an axis;

drive means for rotating the elongated drum in the frame structure about the axis;

a structural means disposed in the interior of the elongated drum for imparting movement to the garments, the movement having a primary component parallel to the axis when the drive means rotates the elongated drum, the structural means comprising at least two continuous helical flights of varying pitch located inside and throughout a length of the elongated drum, wherein each of said continuous helical flights comprises two opposing sides, and wherein at least one of said continuous helical flights further includes at least one side with at least two projecting plates extending longitudinally at least part way along said one side.

8. An apparatus as set forth in claim 7, wherein said continuous helical flights comprise a pair of continuous helical flights, and wherein a pair of projecting plates extends at least part way along one of the opposing sides of each of said pair of continuous helical flights.

9. An apparatus as set forth in claim 8, wherein holes are provided in said pair of continuous helical flights.

10. An apparatus as set forth in claim 8, wherein said pitch of each of said pair of continuous helical flights changes throughout the length of the elongated drum.

11. An apparatus as set forth in claim 10, wherein said pitch is flat in a lower end of the elongated drum and increases near an upper end of the elongated drum.

12. An apparatus as set forth in claim 11, wherein said pair of continuous helical flights has a designated height at the lower end of said elongated drum and wherein the height of said pair of continuous helical flights tapers down to a smaller value about half-way through the lower end of said elongated drum.

13. An apparatus as set forth in claim 12, wherein the apparatus further comprises temperature-control means to adjust the temperature in said elongated drum to control the temperature of the garment-treating operation.

14. An apparatus as set forth in claim 11, further comprising a drum drain screen and a drain screen support in the lower end of said elongated drum, and wherein said pair of continuous helical flights has a designated height at the drain screen support and wherein the height of said pair of continuous helical flights tapers down to a smaller value about half-way through the lower end of said elongated drum.

15. An apparatus as set forth in claim 10, wherein said drive means for rotating said elongated drum in said frame structure comprises a shaft at a lower end of said elongated drum, wherein said shaft is constructed to have at least one line connected thereto for introducing and removing liquids from said elongated drum, and wherein each of said lines is connected to said shaft through a union that allows said shaft to rotate while each of said lines remains stationary with said frame structure.

16. An apparatus as set forth in claim 15, further comprising a recirculation pump connected to each of said lines to recirculate the liquids through the apparatus.

17. An apparatus as set forth in claim 8, wherein said pair of continuous helical flights are oriented 180° out of phase relative to each other and have a lead angle relative to a wall of said elongated drum.

* * * * *